US009367019B2

(12) United States Patent
Ohata

(10) Patent No.: US 9,367,019 B2
(45) Date of Patent: Jun. 14, 2016

(54) ELECTRIC WIRE MEMBER AND IMAGE FORMING APPARATUS INCLUDING THE SAME

(71) Applicant: KYOCERA Document Solutions Inc., Osaka (JP)

(72) Inventor: Shinobu Ohata, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/747,149

(22) Filed: Jun. 23, 2015

(65) Prior Publication Data

US 2015/0378303 A1 Dec. 31, 2015

(30) Foreign Application Priority Data

Jun. 30, 2014 (JP) ..... 2014-134090
Jun. 30, 2014 (JP) ..... 2014-134109

(51) Int. Cl.

| | |
|---|---|
| ***G03G 15/00*** | (2006.01) |
| ***H01B 1/02*** | (2006.01) |
| ***G03G 21/16*** | (2006.01) |
| ***G03G 21/18*** | (2006.01) |

(52) U.S. Cl.

CPC ..... *G03G 15/80* (2013.01); *G03G 21/1652* (2013.01); *G03G 21/1867* (2013.01); *H01B 1/02* (2013.01); *G03G 2215/0132* (2013.01)

(58) Field of Classification Search

CPC ..... G03G 15/80; G03G 21/1652; G03G 21/1867; G03G 2215/0132; H01B 1/02; H01B 5/04

See application file for complete search history.

(56) References Cited

U.S. PATENT DOCUMENTS

| | | | | |
|---|---|---|---|---|
| 6,973,276 | B2 * | 12/2005 | Mizoguchi | G03G 21/185 399/90 |
| 7,062,192 | B2 * | 6/2006 | Oguma | G03G 21/1828 399/111 |
| 7,136,603 | B2 * | 11/2006 | Kawai | G03G 15/0812 399/119 |
| 7,761,024 | B2 * | 7/2010 | Imaizumi | G03G 21/1871 399/112 |
| 7,773,905 | B2 * | 8/2010 | Kuruma | G03G 21/1867 399/111 |
| 8,038,483 | B2 * | 10/2011 | Souda | B41J 2/471 439/700 |
| 8,145,096 | B2 * | 3/2012 | Kawanami | G03G 21/1853 399/110 |
| 8,532,524 | B2 * | 9/2013 | Souda | G03G 21/16 399/107 |
| 2003/0142991 | A1 * | 7/2003 | Arimitsu | G03G 21/1825 399/90 |
| 2005/0191079 | A1 * | 9/2005 | Yokoi | G03G 21/1871 399/90 |
| 2006/0067725 | A1 * | 3/2006 | Miyabe | G03G 21/1871 399/90 |
| 2006/0153587 | A1 | 7/2006 | Omura et al. | |

(Continued)

FOREIGN PATENT DOCUMENTS

JP 2010-008670 1/2010

*Primary Examiner* — David Bolduc

(74) *Attorney, Agent, or Firm* — Wenderoth, Lind & Ponack, L.L.P.

(57) ABSTRACT

An electric wire member includes at least one bending portion that electrically connects a processing unit for performing an image forming process on a paper to a high voltage board for supplying a high voltage to the processing unit, and the at least one bending portion includes a coil type bending portion having a coil shape of one turn or more.

8 Claims, 9 Drawing Sheets

(56) References Cited

U.S. PATENT DOCUMENTS

2007/0071482 A1* 3/2007 Okabe ..... G03G 21/1867 399/90
2007/0154232 A1* 7/2007 Buchanan ..... G03G 21/1867 399/90
2008/0031656 A1* 2/2008 Okabe ..... G03G 21/1871 399/241
2008/0170875 A1* 7/2008 Kim ..... G03G 15/0896 399/90
2008/0193156 A1 8/2008 Omura et al.
2008/0310881 A1* 12/2008 Sato ..... G03G 15/0813 399/90
2009/0169251 A1* 7/2009 Itabashi ..... G03G 21/1814 399/115
2009/0214245 A1* 8/2009 Ito ..... G03G 15/80 399/88
2009/0257800 A1* 10/2009 Furuya ..... G03G 15/6511 399/376
2010/0080613 A1* 4/2010 Itabashi ..... G03G 21/1814 399/111
2010/0239306 A1* 9/2010 Souda ..... G03G 21/1867 399/107
2010/0329757 A1* 12/2010 Souda ..... G03G 21/1671 399/381
2011/0198360 A1* 8/2011 Aoki ..... B41J 2/1753 220/694
2011/0199439 A1* 8/2011 Aoki ..... B41J 2/17513 347/85
2011/0299874 A1 12/2011 Fujiwara
2012/0308258 A1* 12/2012 Ming Wang ..... G03G 21/1652 399/107
2013/0188982 A1* 7/2013 Souda ..... G03G 21/1652 399/90
2014/0153952 A1* 6/2014 Okamoto ..... G03G 21/1652 399/90
2014/0193179 A1* 7/2014 Tomoda ..... G03G 21/1821 399/267

* cited by examiner

ELECTRIC WIRE MEMBER AND IMAGE FORMING APPARATUS INCLUDING THE SAME

CROSS-REFERENCE TO RELATED APPLICATION

This application is based upon and claims the benefit of priority from Japanese Patent Application No. 2014-134090 filed on Jun. 30, 2014 and Japanese Patent Application No. 2014-134109 filed on Jun. 30, 2014, the entire contents of which are incorporated herein by reference.

BACKGROUND

The technology of the present disclosure relates to an electric wire member and an image forming apparatus including the same.

In general, an image forming apparatus using an electrophotographic system has a plurality of processing units for performing an image forming process on a paper. The processing unit, for example, includes a photosensitive drum unit on which a toner image is formed, a developing unit, or an intermediate transfer unit. The developing unit supplies toner to a photosensitive drum to form a toner image on the photosensitive drum. The intermediate transfer unit has an intermediate transfer belt onto which a color toner image is transferred in a case in which an image forming apparatus is a tandem type image forming apparatus.

Furthermore, the image forming apparatus has a high voltage board for supplying a high voltage to these processing units. The processing unit and the high voltage board are connected to each other by an electric wire member made of a metal wire.

SUMMARY

An electric wire member according to one aspect of the present disclosure includes at least one bending portion that electrically connects a processing unit for performing an image forming process on a paper to a high voltage board for supplying a high voltage to the processing unit. The at least one bending portion includes a coil type bending portion having a coil shape of one turn or more.

An image forming apparatus according to one aspect of the present disclosure includes a processing unit that performs an image forming process on a paper, the electric wire member of claim 1, which supplies electric power to the processing unit, and a holding frame that holds the electric wire member.

DETAILED DESCRIPTION

Hereinafter, the present embodiments will now be described on the basis of the drawings. Descriptions of the following preferred embodiments are essentially merely examples, and the technology of the present disclosure is not intended to limit an applied object thereof or the use thereof.

Embodiment 1

Figure 1:
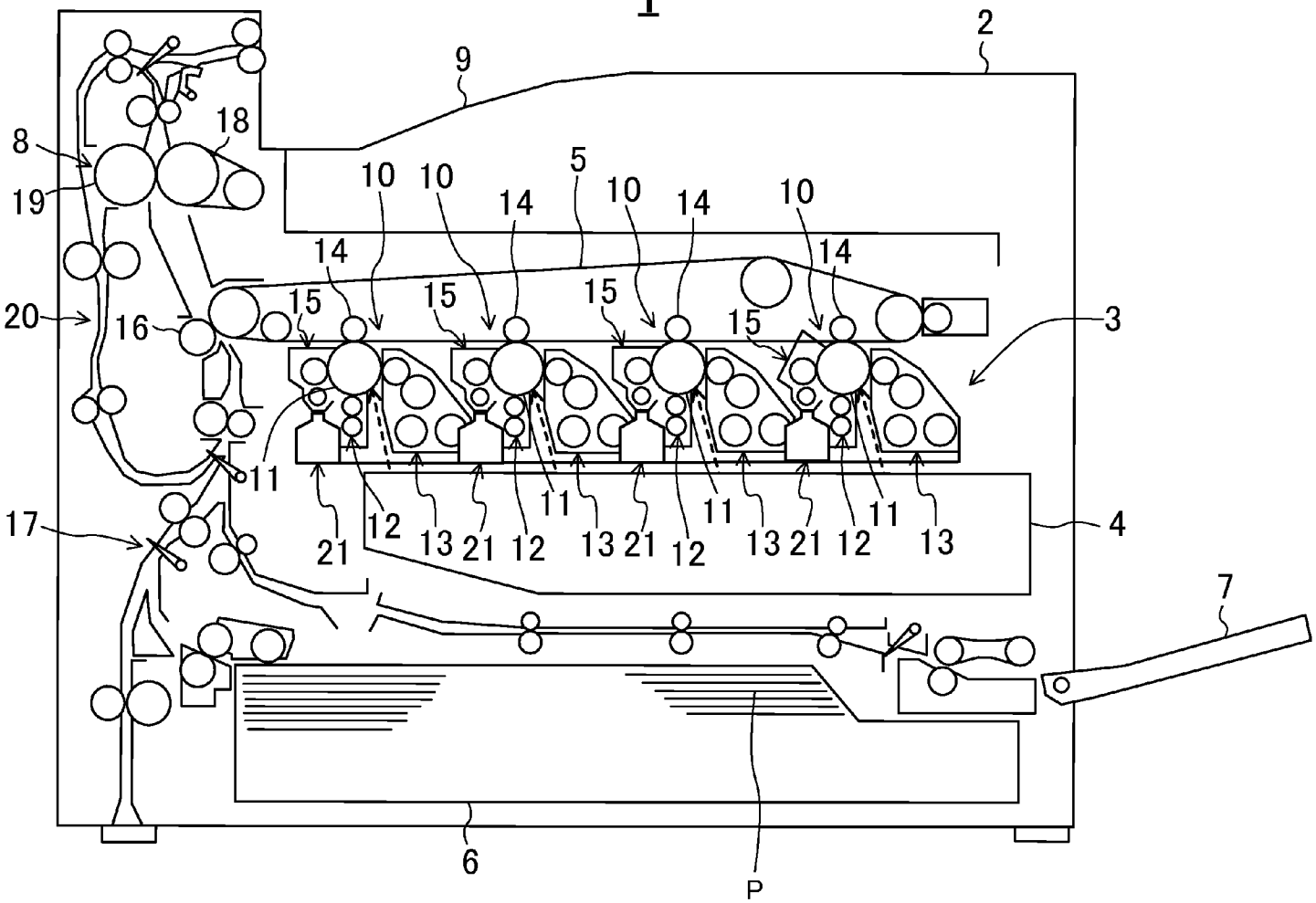
FIG. 1 is a longitudinal sectional view illustrating an image forming apparatus provided with an electric wire member in an embodiment.

FIG. 1 illustrates a schematic configuration diagram of an image forming apparatus 1 provided with an electric wire member E in the present embodiment. The image forming apparatus 1 is a tandem type color printer and includes an image forming unit 3 in a box-like casing 2. The image forming unit 3 transfers an image to a recording paper P on the basis of image data transmitted from an external device such as a network-connected computer. Below the image forming unit 3, an exposure device 4 is disposed to irradiate laser light, and above the image forming unit 3, a transfer belt 5 is disposed. Below the exposure device 4, a paper storage unit 6 is disposed to store the recording paper P, and at a lateral side of the paper storage unit 6, a manual paper feeding unit 7 is disposed. Above the lateral side of the transfer belt 5, a fixing unit 8 is disposed to perform a fixing process on the image transferred to the recording paper P. A reference numeral 9 indicates a paper discharge unit disposed at an upper portion of the casing 2 to discharge the recording paper P subjected to the fixing process in the fixing unit 8.

The image forming unit 3 includes four photosensitive drum units 10 disposed in a row along the transfer belt 5. Each of the photosensitive drum units 10 has a photosensitive drum 11. Directly under each photosensitive drum 11, a charging device 12 is disposed, and at one lateral side of each photosensitive drum 11, a developing device 13 is disposed. Directly above each photosensitive drum 11, a primary transfer roller 14 is disposed, and at the other lateral side of each photosensitive drum 11, a cleaning unit (hereinafter, referred to as a cleaning device) 15 is disposed to clean a peripheral surface of each photosensitive drum 11.

Furthermore, the peripheral surface of each photosensitive drum 11 is uniformly charged by the charging device 12, and laser light corresponding to each color based on the image data input from the aforementioned computer and the like is irradiated to the peripheral surface of each charged photosensitive drum 11 from the exposure device 4, so that an electrostatic latent image is formed on the peripheral surface of each photosensitive drum 11. A developer is supplied to the electrostatic latent image from the developing device 13, so that a yellow, magenta, cyan, or black toner image is formed on the peripheral surface of each photosensitive drum 11. These toner images are respectively superposed on and transferred to the transfer belts 5 by a transfer bias applied to the primary transfer roller 14.

A reference numeral 16 indicates a secondary transfer roller disposed below the fixing unit 8 in contact with the transfer belt 5, and the secondary transfer roller 16 is configured to interpose the recording paper P conveyed along a paper conveyance path 17 from the paper storage unit 6 or the manual paper feeding unit 7 between the secondary transfer roller 16 and the transfer belt 5, and to transfer the toner images of the transfer belt 5 to the recording paper P by a transfer bias applied to the secondary transfer roller 16.

The fixing unit 8 includes a heating roller 18 and a pressing roller 19, and is configured to heat and press the recording paper P while interposing the recording paper P between these heating roller 18 and pressing roller 19, thereby fixing the toner images, which have been transferred to the recording paper P, to the recording paper P. The recording paper P subjected to the fixing process is discharged to a paper discharge unit 9. A reference numeral 20 indicates a reversing conveyance path for reversing the recording paper P discharged from the fixing unit 8 at the time of duplex printing.

Figure 2:
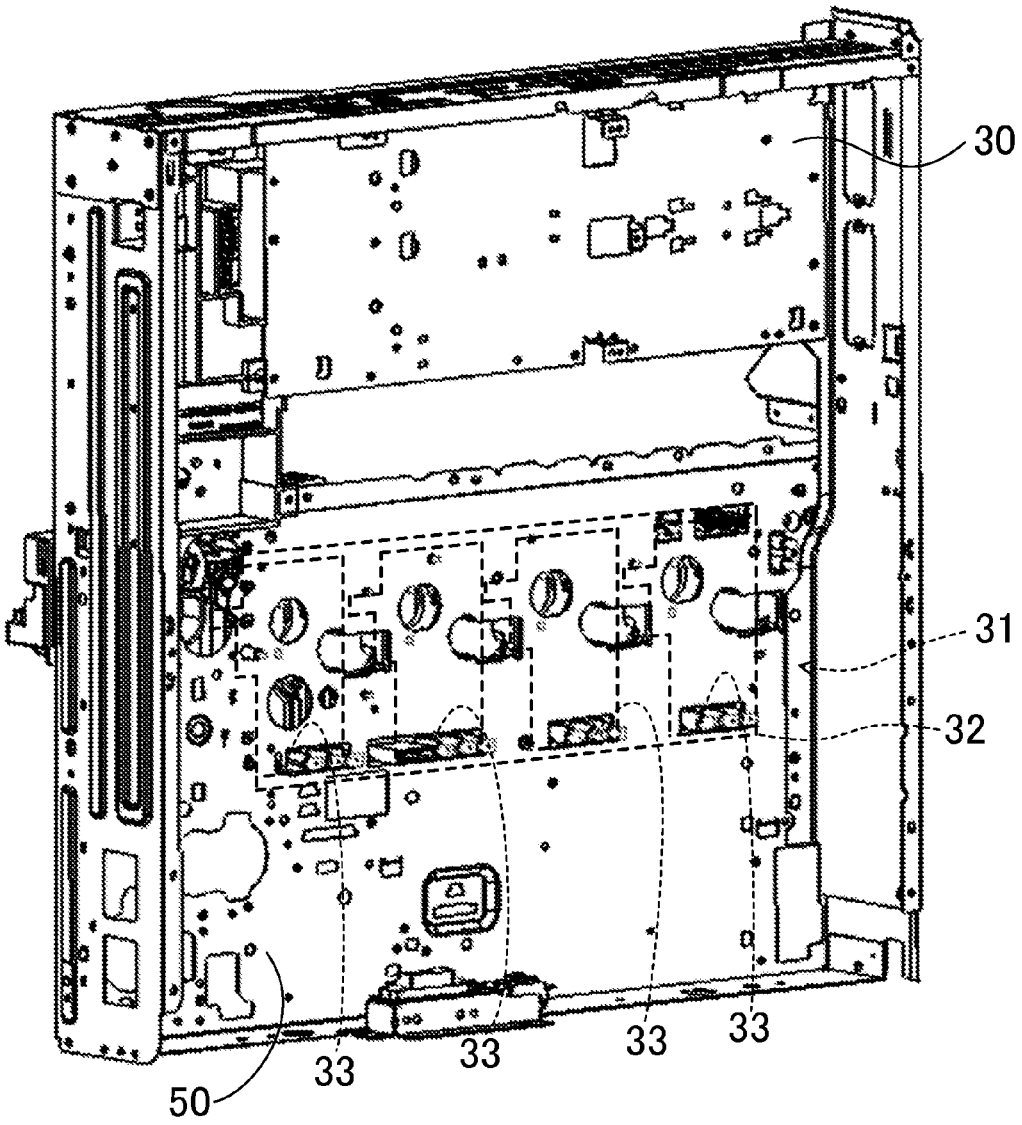
FIG. 2 is a perspective view illustrating a rear frame part of an image forming apparatus.

FIG. 2 is a perspective view of the image forming apparatus 1 when viewed from the rear side. The rear side of the image forming apparatus 1 is typically covered by a sheet metal cover, but FIG. 2 illustrates the state in which the sheet metal cover has been detached. A reference numeral 30 of FIG. 2 indicates a sheet metal frame mounted at a rear upper portion of the casing 2. The sheet metal frame 30 is mounted at a lower end portion thereof with a resinous electric wire holding frame 31, and the electric wire holding frame 31 is mounted at a rear side thereof with a high voltage board 50. The high voltage board 50 is a board for supplying a high voltage to various processing units for performing an image forming process on a sheet. The high voltage board 50 has a mounting surface on which various elements for power supply such as a high pressure semiconductor element and a transformer are mounted. The high voltage board 50 is disposed such that the mounting surface faces a base plate 32 of the electric wire holding frame 31.

The electric wire holding frame 31 holds a plurality of electric wire members E that electrically connect the aforementioned each processing unit to the aforementioned high voltage board 50. Each electric wire member E is formed by plastically deforming a metal wire. The aforementioned processing units include the photosensitive drum unit 10, the developing device 13, the intermediate transfer unit and the like.

The aforementioned electric wire holding frame 31 has the base plate 32 having a plate shape. The base plate 32 is disposed vertically at a rear side of the four photosensitive drum units 10. The total four wire holding areas 33 are provided on a surface of the base plate 32, which is opposite to the photosensitive drum units 10 side, in correspondence to the four photosensitive drum units 10. The electric wire member E is held to each wire holding area 33. The electric wire member is connected to various processing units such as the photosensitive drum unit 10, the developing device 13, and the intermediate transfer unit. Since the configurations of the wire holding areas 33 are equal to one another, only the wire holding area 33 (see FIG. 3) positioned at the most left side when viewed from the rear side of the image forming apparatus 1 will be described below.

Figure 3:
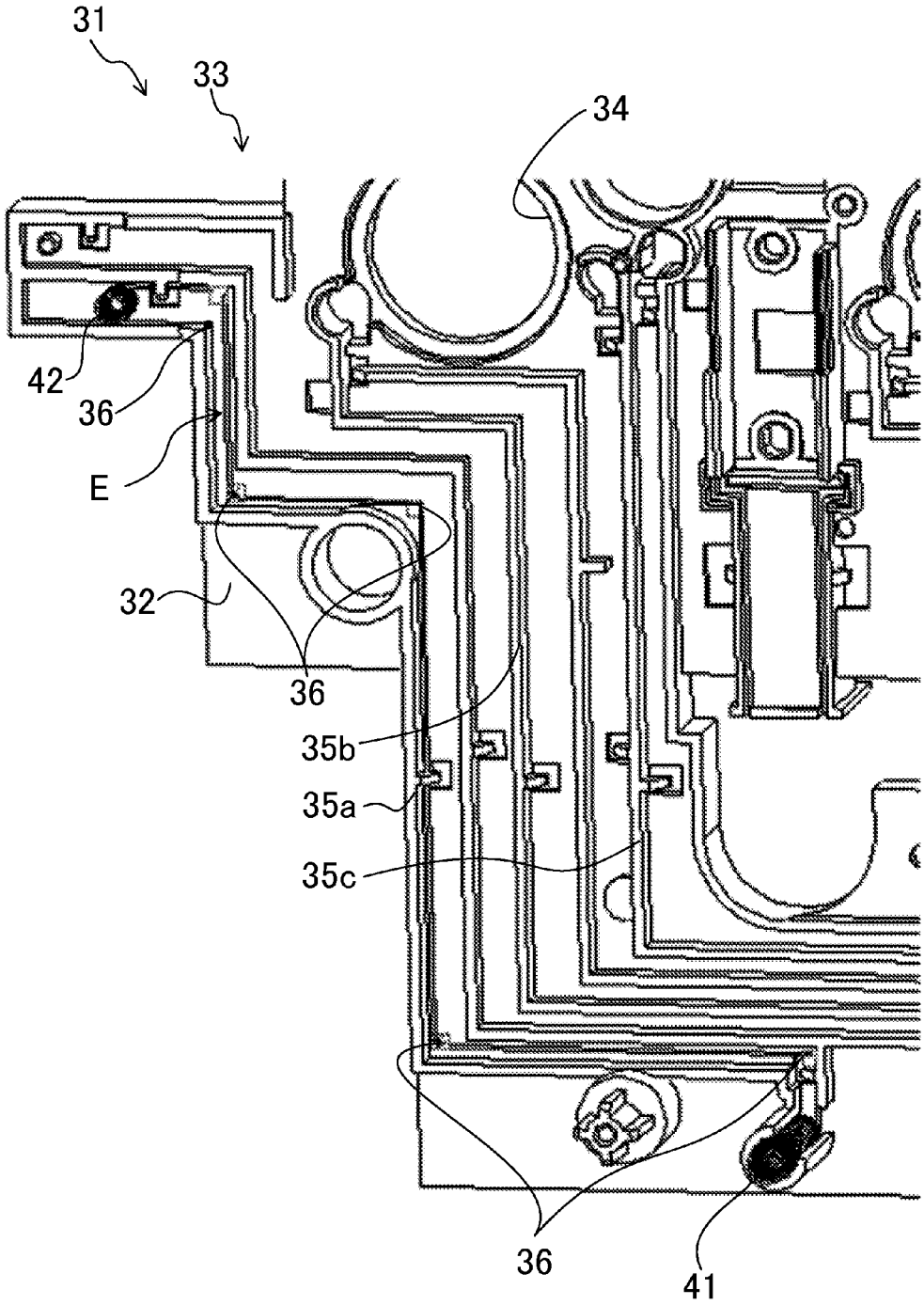
FIG. 3 is an enlarged view enlarging and illustrating a part of an electric wire holding frame.

As illustrated in FIG. 3, a plurality of guide walls 35*a* to 35*c* are vertically installed at the wire holding areas 33. Among the guide walls 35*a* to 35*c*, the guide wall 35*a* guides the electric wire member E connected to the photosensitive drum unit 10. The electric wire member E is disposed along the guide wall 35*a*. The guide wall 35*a* is bent stepwise in correspondence to the shape of the electric wire member E. A plurality of (five in the present embodiment) boss parts 36 are provided at the guide surface side of the guide wall 35*a*. Each boss part 36 protrudes from the base plate 32 and is used in the positioning of the electric wire member E when the electric wire member E is assembled to the image forming apparatus 1. In the present embodiment, each protruding boss part 36 is formed in a cylindrical shape. However, the present invention is not limited thereto, and for example, each protruding boss part 36 may be formed in a square columnar shape or a triangular columnar shape. A reference numeral 34 of FIG. 3 indicates a through hole through which a driving axis of the photosensitive drum unit 10 passes.

Figure 4:
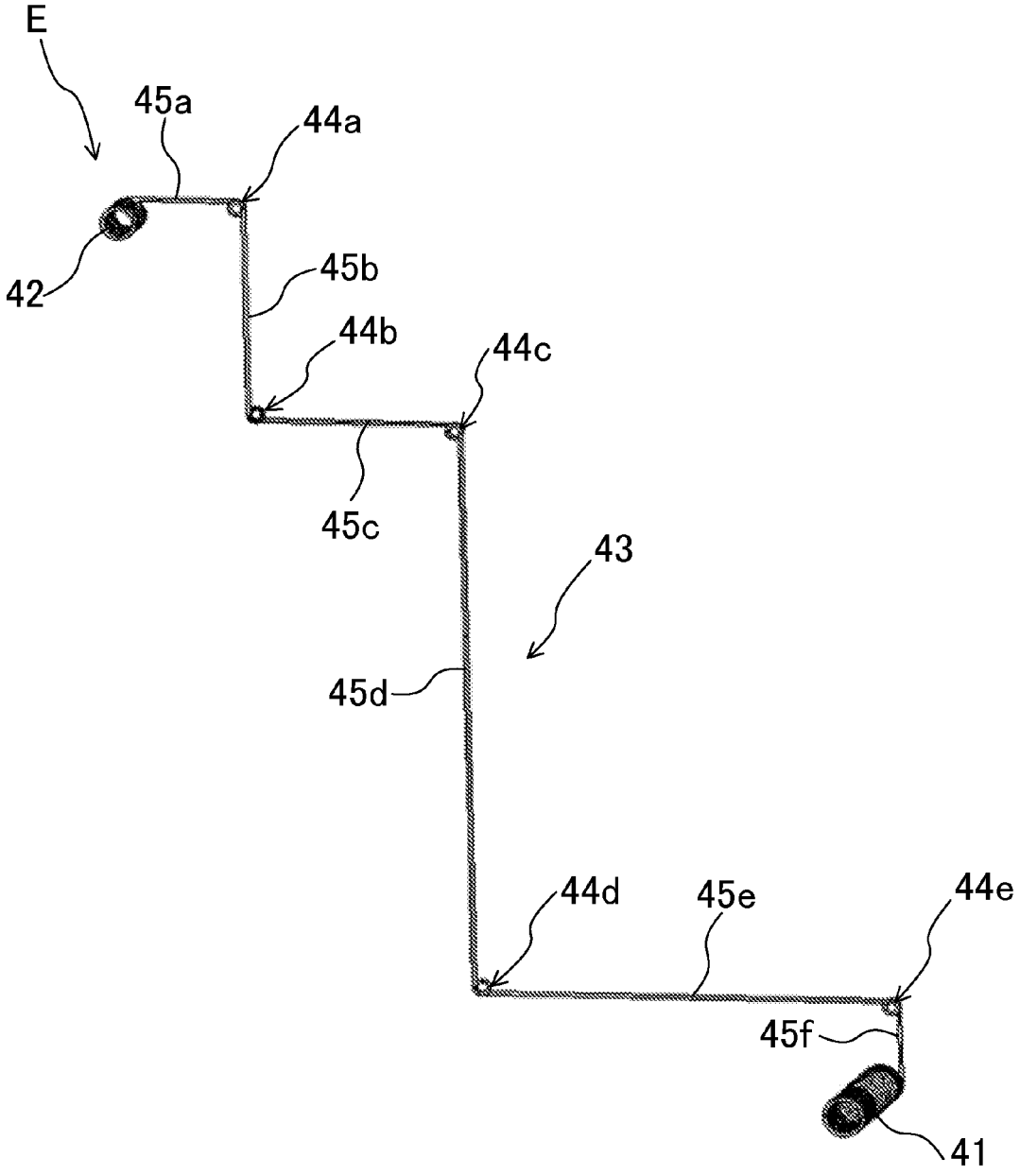
FIG. 4 is a perspective view illustrating an electric wire member in an embodiment 1.

As illustrated in FIG. 4, the electric wire member E is configured by one wire. The electric wire member E has an input side connection part 41, an output side connection part 42, and a connection line part 43 that connects the input side connection part 41 and the output side connection part 42 to each other. The aforementioned wire, for example, is made of spring steel.

The input side connection part 41 and the output side connection part 42 of the aforementioned electric wire member E are formed in a coil shape (also called a spiral line) of a plurality of windings. In the state in which the high voltage board 50 has been mounted in the electric wire holding frame 31, the input side connection part 41 is compressively deformed while being interposed between the high voltage board 50 and the base plate 32 of the electric wire holding frame 31. In this way, it is possible to sufficiently ensure contact pressure between the input side connection part 41 and the high voltage board 50. The output side connection part 42 passes through the base plate 32 and abuts a connection terminal (not illustrated) provided to the photosensitive drum unit 10. In the state in which the high voltage board 50 has been mounted in the electric wire holding frame 31, the output side connection part 42 is compressively deformed while being interposed between the high voltage board 50 and the connection terminal of the photosensitive drum unit 10. In this way, it is possible to sufficiently ensure contact pressure between the output side connection part 42 and the connection terminal of the photosensitive drum unit 10.

Figure 5:
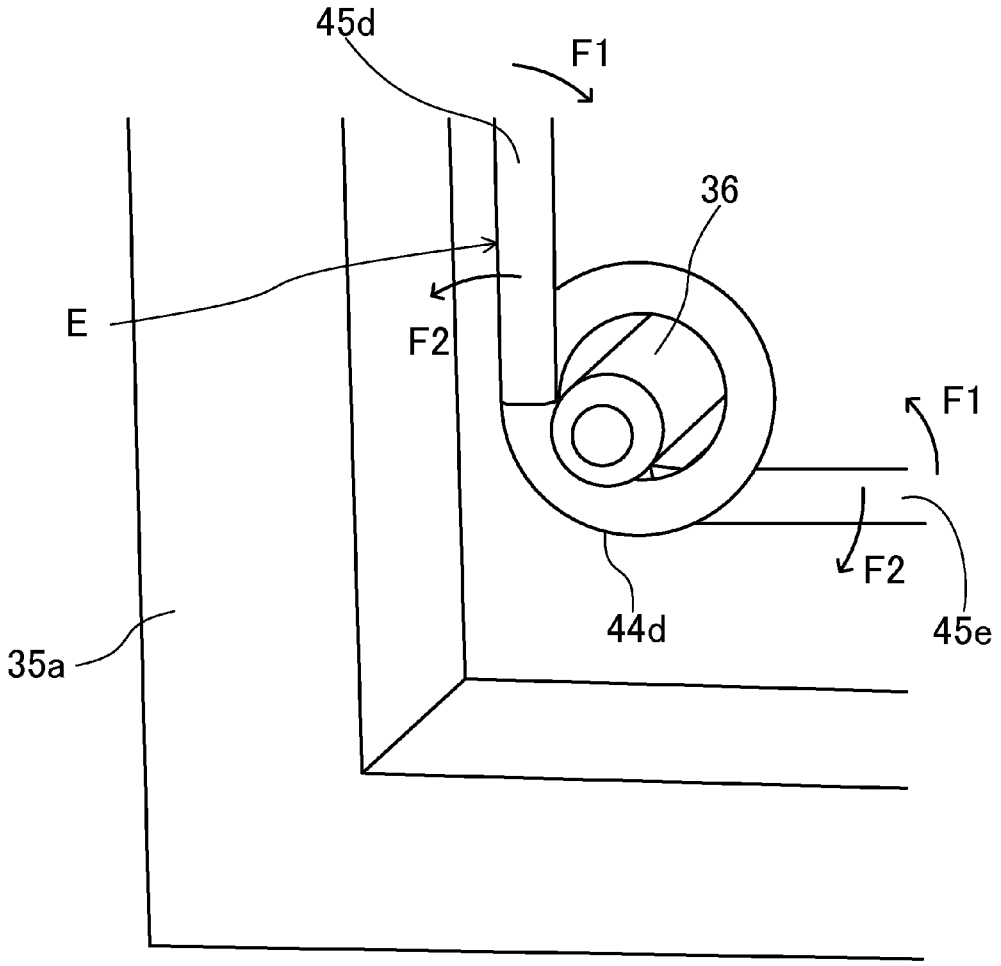
FIG. 5 is an enlarged view enlarging and illustrating a bending portion of an electric wire member assembled to an electric wire holding frame.

The aforementioned connection line part 43 extends from one end of the output side connection part 42 in a tangential direction of the output side connection part 42, is bent stepwise in the same plane toward an obliquely lower right side of FIG. 4, and then is connected to one end of the input side connection part 41 from a tangential direction of the input side connection part 41. In detail, the connection line part 43 has five bending portions 44*a* to 44*e* and six linear portions 45*a* to 45*f*. Each of the bending portions 44*a* to 44*e* is a portion formed by winding a wire by one turn to deform the wire in a coil shape and bending the wire at an angle of about 90°. As illustrated in FIG. 5, each of the bending portions 44*a* to 44*e* (FIG. 5 illustrates only the bending portion 44*d*) is positioned by being fitted onto the boss part protruding from a place of the base plate 32, which corresponds to each of the bending portions 44*a* to 44*e*. In this way, the positioning accuracy of the electric wire member E is improved.

As described above, in the aforementioned embodiment, a wire is bent at a plurality of places to form the electric wire member E, so that it is possible to assemble the electric wire member E to predetermined places of the image forming apparatus 1 without interference with other parts.

In addition, since the bending portions 44*a* to 44*e* of the electric wire member E are configured by coil type bending portions each having a coil shape of one turn, at the time of assembling work of the electric wire member E, even though force in a bending direction (a direction F1 in the example of FIG. 5) or a bending release direction (a direction F2 in the example of FIG. 5) has been temporarily applied to each of the bending portions 44*a* to 44*e*, bending angles of the bending portions 44*a* to 44*e* naturally return to the initial angle (90° in the aforementioned embodiment) by the restoring force of a coil. Consequently, it is possible to easily assemble the electric wire member E to predetermined places of the electric wire holding frame 31 while preventing the electric wire member E from being plastically deformed in each of the bending portions 44*a* to 44*e*.

Furthermore, in the aforementioned embodiment, a wire constituting the electric wire member E is made of spring steel. Consequently, it is possible to enhance the flexibility (the elasticity) of the electric wire member E. Thus, when the electric wire member E is assembled to the electric wire holding frame 31, it is possible to reliably prevent the electric wire member E from being plastically deformed in the bending portions 44*a* to 44*e*. Consequently, it is possible to enhance the assembling accuracy of the electric wire member E as much as possible.

<<Modification>>

Figure 6:
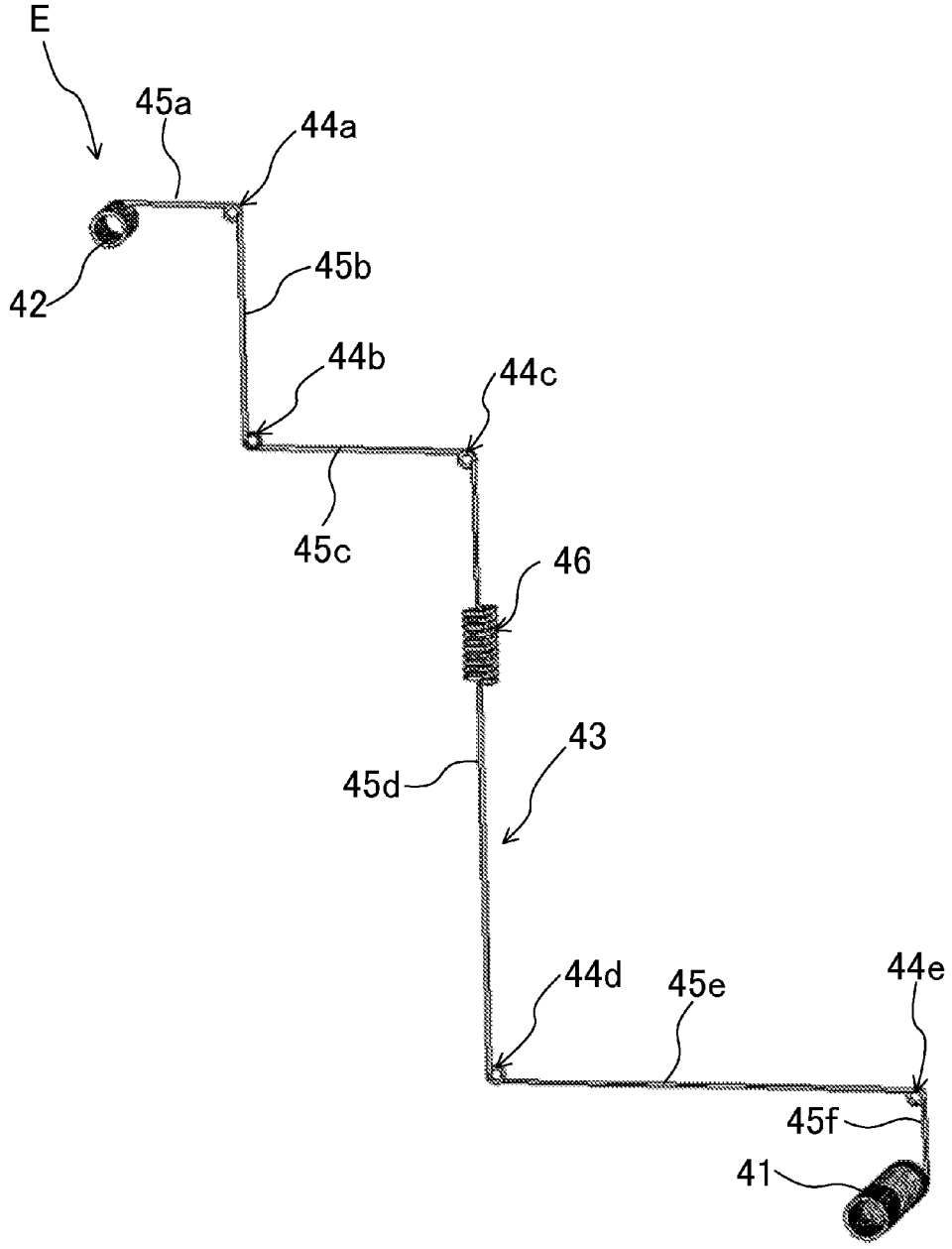
FIG. 6 is a perspective view illustrating an electric wire member in a modification of an embodiment 1.

FIG. 6 illustrates the deformability of the embodiment 1. The present modification is different from the aforementioned embodiment in that an expandable portion 46 has been configured to be formed at an intermediate portion of the linear portion 45*d* positioned between the two bending portions 44*c* and 44*d*. The same reference numerals are used to designate the same elements as those of FIG. 5 and a detailed description thereof will be omitted. The expandable portion 46 is formed in a coil shape (also called a spiral line) of a plurality of windings and is configured to be expandable in a coil axis direction.

According to such a configuration, at the time of assembling work of the electric wire member E, even though a bending load and a buckling load have been applied to the aforementioned linear portion 45*d*, these loads are absorbed by the expansion and contraction of the expandable portion 46, so that it is possible to prevent the aforementioned linear portion 45*d* from being plastically deformed. Thus, it is possible to further enhance the assembling accuracy (positioning accuracy) of the electric wire member E.

In the aforementioned embodiment 1 and modification, each of the bending portions 44*a* to 44*e* having a coil shape and formed at the electric wire member E is fitted onto the boss part 36 having a cylindrical shape; however, the protruding boss part 36 is not necessarily needed.

In the aforementioned embodiment 1 and modification, the number of windings of each of the bending portions 44*a* to 44*e* is one. However, the present invention is not limited thereto and the number of windings may also be two or more.

In the aforementioned embodiment 1 and modification, the bending portions 44*a* to 44*e* are formed at five places of the electric wire member E. However, the present invention is not limited thereto and it is sufficient if at least one of the bending portions 44*a* to 44*e* is configured to be formed.

In the aforementioned modification, the expandable portion 46 is configured to be formed at one linear portion 45*d* of the six linear portions 45*a* to 45*f*. However, the present invention is not limited thereto and for example, the expandable portion 46 may also be configured to be formed at all of the six linear portions 45*a* to 45*f*.

Furthermore, the technology of the present disclosure is not limited to the aforementioned each embodiment and modification, and configurations obtained by appropriately combining the embodiment and modification with each other are included in the technology of the present disclosure.

Embodiment 2

Figure 7:
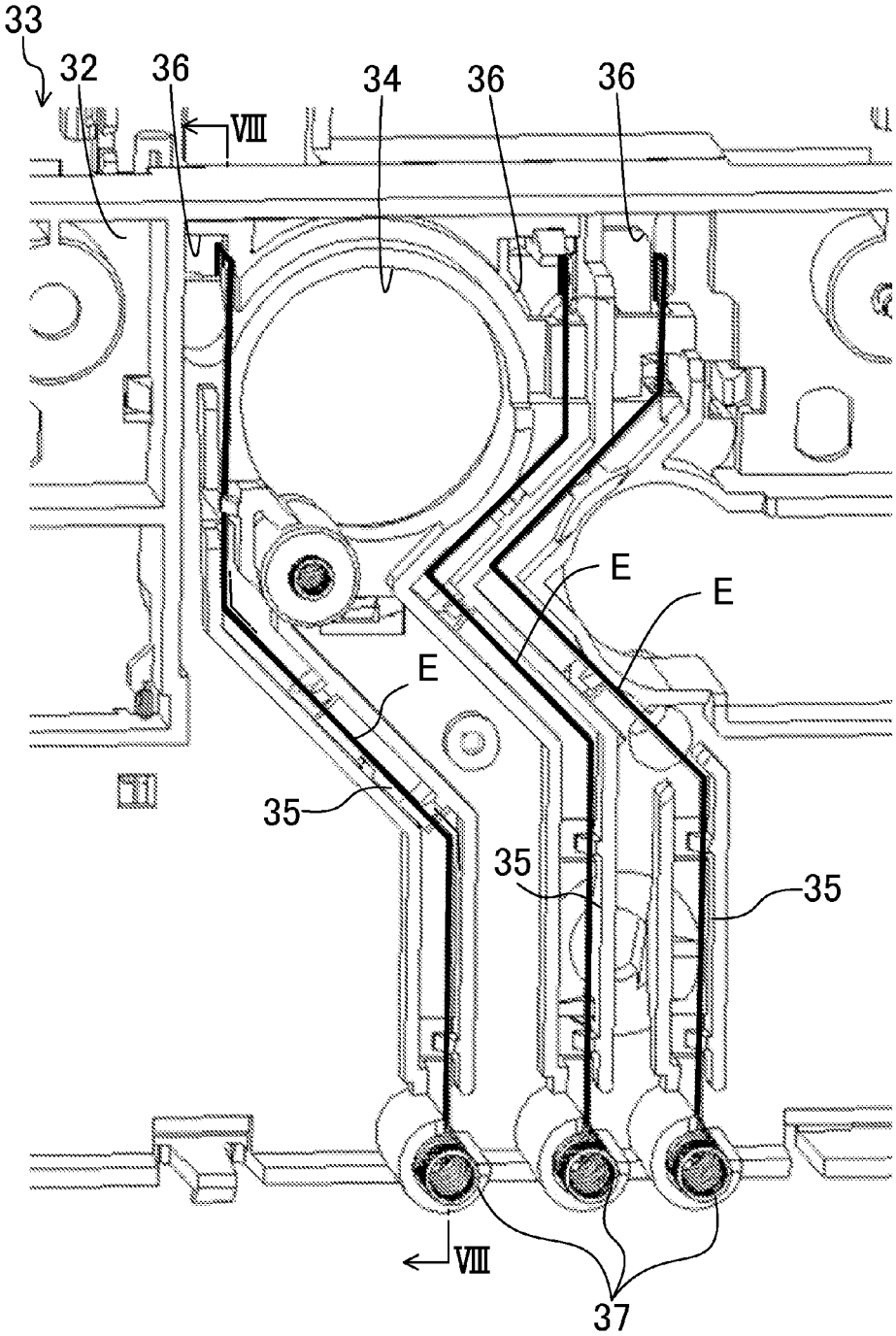
FIG. 7 is a view corresponding to FIG. 3, which illustrates an embodiment 2.
Figure 8:
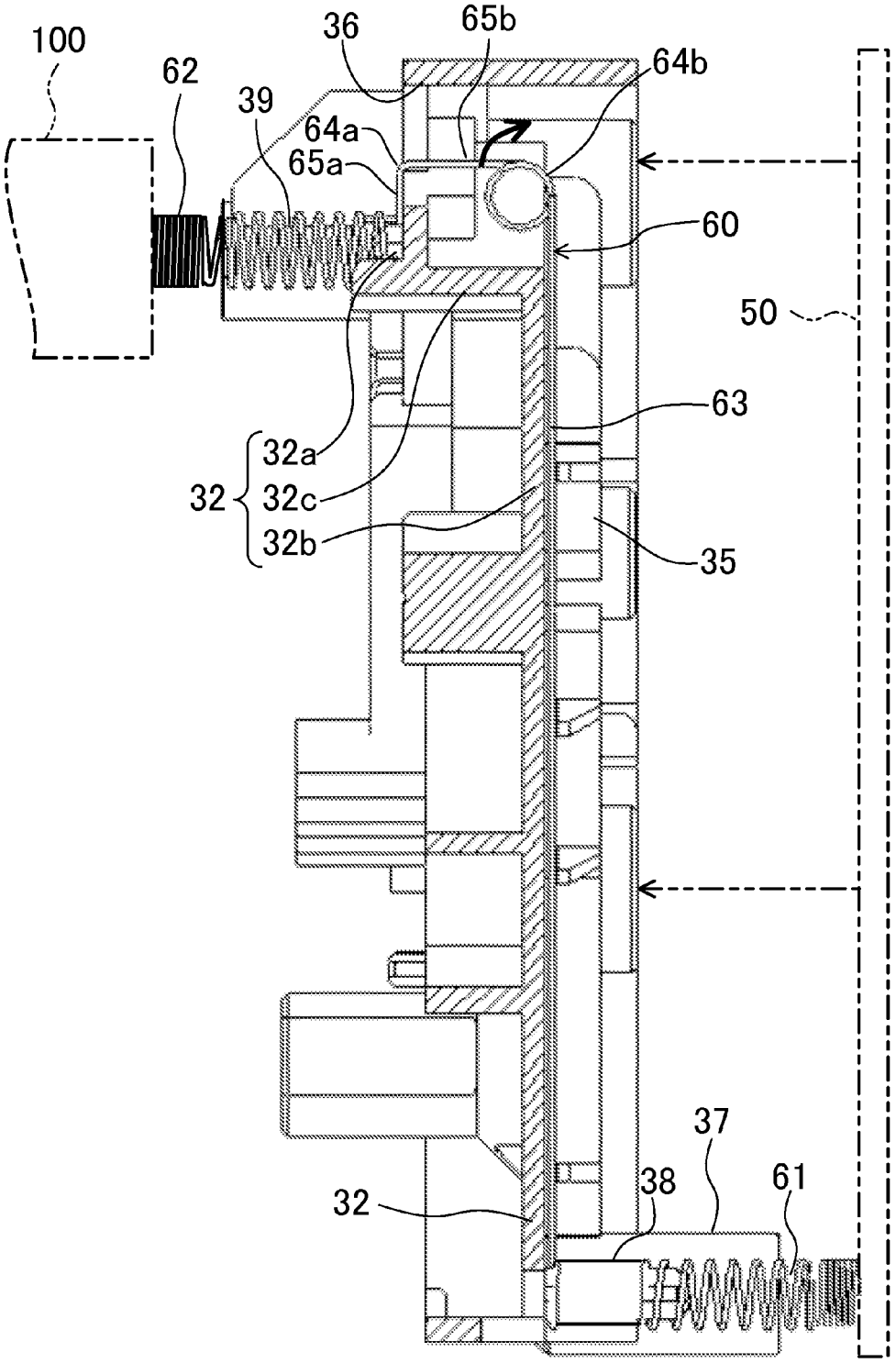
FIG. 8 is a sectional view taken along line VIII-VIII of FIG. 7.
Figure 9:
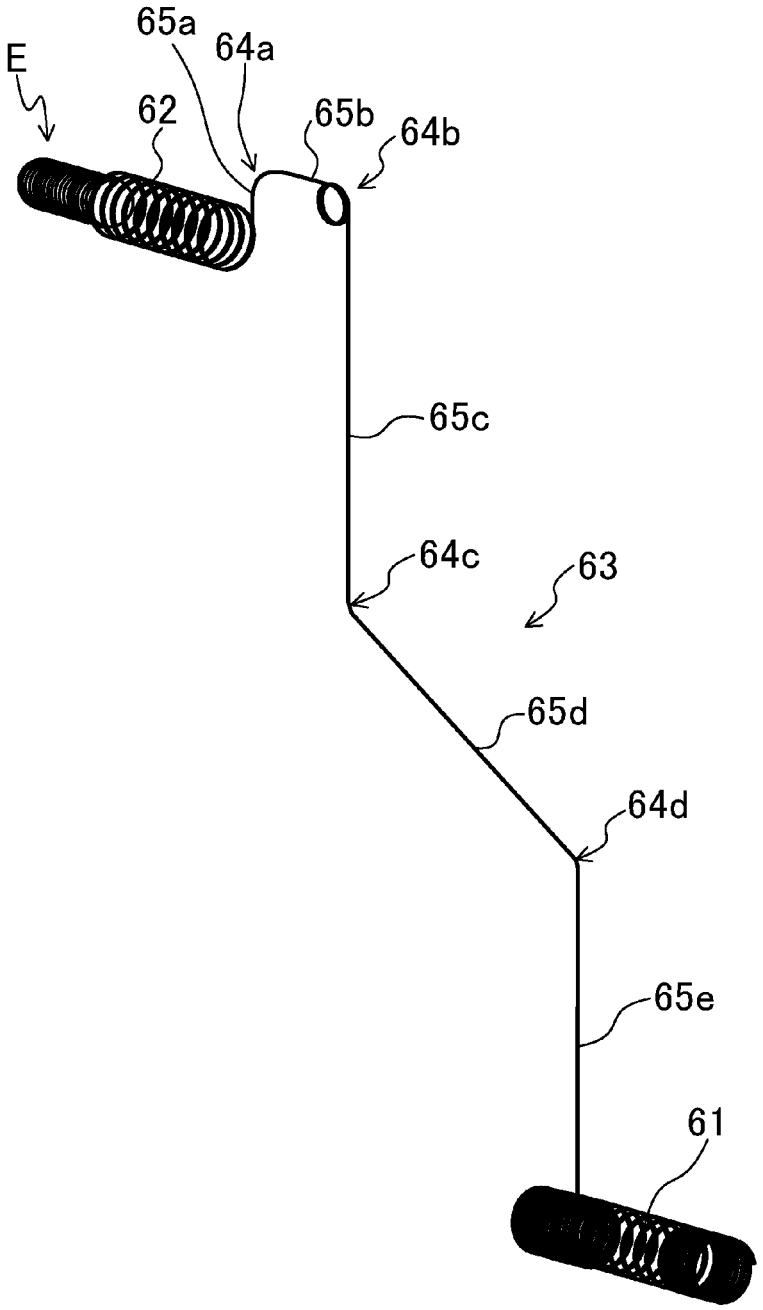
FIG. 9 is a perspective view illustrating an electric wire member in an embodiment 2.

FIG. 7 to FIG. 9 illustrate an embodiment 2. The present embodiment is different from the aforementioned embodiment 1 and modification in that the electric wire member E is disposed to so as to pass through the base plate 32 disposed between a processing unit 100 and the high voltage board 50.

The aforementioned base plate 32 is a part of the electric wire holding frame 31. The base plate 32 is disposed so as to cover the rear sides of the four photosensitive drum units 10. Furthermore, the base plate 32 constitutes a partition plate disposed between the processing unit 100 and the high voltage board 50. The base plate 32 has an upper vertical plate part 32*a*, a lower vertical plate part 32*b*, and a horizontal plate part 32*c* that connects both vertical plate parts 32*a* and 32*b* (see FIG. 8) to each other. The total four wire holding areas 33 (see FIG. 2) are provided to the surface of the base plate 32 facing the high voltage board 50 side in correspondence to the four photosensitive drum units 10. A plurality of electric wire members E are held to each wire holding area 33. The plurality of electric wire members E are connected to various processing units 100 such as the photosensitive drum unit 10, the developing device 13, and the intermediate transfer unit. Since the configurations of the wire holding areas 33 are equal to one another, only the wire holding area 33 positioned at the most right side of the image forming apparatus 1 will be described below.

As illustrated in FIG. 7, a plurality of guide walls 35 are vertically installed at the wire holding area 33. The guide walls 35 guide the electric wire members E connected to the processing units 100. The electric wire members E are disposed along the guide walls 35. The guide walls 35 are bent in correspondence to the shapes of the electric wire members E. Through holes 36 are respectively formed at slightly upper portions from the upper end portions of the guide walls 35 in the base plate 32. The electric wire member E passes though a corresponding through hole 36. A holder part 37 and a boss part 38 (see FIG. 8) protrude from slightly lower portions from the lower end portions of the guide walls 35 in the wire holding areas 33 of the base plate 32. The holder part 37 has a shape obtained by chipping a part of a cylinder in a circumferential direction. The boss part 38 is formed in a columnar shape, which is coaxial with the holder part 37. An input side connection part 61 of the electric wire member E is fitted around and is supported to the boss part 38. The holder part 37 is formed so as to surround the outer periphery of the input side connection part 61 fitted onto the boss part 38.

As illustrated in FIG. 8, a boss part 39 having a columnar shape protrudes from the surface of the base plate 32 facing the processing unit 100 side. The boss part 39 is formed below the through hole 36. An output side connection part 62 of the electric wire member E is fitted onto and is supported to the boss part 39.

Each of the aforementioned electric wire members E is configured with one wire made of spring steel. Each electric wire member E is bent at a predetermined place in order to avoid interference with other parts. The basic configurations of the electric wire members E are equal to one another except that their bending angles and the like are slightly different from one another. Therefore, only the electric wire member E positioned at the most left side of FIG. 7 will be described below.

As illustrated in FIG. 9, the aforementioned electric wire member E has the input side connection part 61, the output side connection part 62, and a connection line part 63 that connects the input side connection part 61 and the output side connection part 62 to each other. The input side connection part 61 and the output side connection part 62 of the aforementioned electric wire member E are formed in a coil shape (also called a spiral line) of a plurality of windings. In the state in which the high voltage board 50 has been mounted in the electric wire holding frame 31, the input side connection part 61 is compressively deformed while being interposed between the high voltage board 50 and the base plate 32 of the electric wire holding frame 31. In this way, it is possible to sufficiently ensure contact pressure between the input side connection part 61 and the high voltage board 50. In the state in which the high voltage board 50 has been mounted in the electric wire holding frame 31, the output side connection part 62 is compressively deformed while being interposed between the high voltage board 50 and the connection terminal of the processing unit 100. In this way, it is possible to sufficiently ensure contact pressure between the output side connection part 62 and the connection terminal of the processing unit 100.

The aforementioned connection line part 63 has first to fifth linear portions 65*a* to 65*e*, and first to fourth bending portions 64*a* to 64*d* positioned at boundary parts of these five linear portions 65*a* to 65*e*. The connection line part 63 extends upward from one end of the output side connection part 62 along a tangential direction of the output side connection part 62, is bent at the first bending portion 64*a* at an approximately right angle to horizontally extend from the processing unit 100 side toward the high voltage board 50 side, is bent at the second bending portion 64*b* at an approximately right angle to extend downward, is then bent at the third bending portion 64*c* to extend at an obliquely lower side, and is finally bent downward at the fourth bending portion 64*d* to be connected to the input side connection part 61 from a tangential direction of the input side connection part 61. The first linear portion 65*a* and the first bending portion 64*a* are positioned at the processing unit 100 side from the base plate (see FIG. 8). The second linear portion 65*b* passes through the through hole 36 of the base plate 32. The third to fifth linear portions 65*c* to 65*e* and the second to fourth bending portions 64*b* to 64*d* are positioned at the high voltage board side from the base plate 32. Furthermore, the second bending portion 64*b* connected to an end portion of the second linear portion 65*b* facing the high voltage board 50 side serves as a coil type bending portion having a coil shape of one turn.

When the aforementioned electric wire member E is assembled to the image forming apparatus 1, the output side connection part 62 of the electric wire member E is first inserted into the processing unit 100 side, instead of the base plate 32, from the through hole 36 of the base plate 32. Furthermore, while force of a bending release side (a side of an arrow of FIG. 8) is being applied to the second bending portion 64*b* which is the coil type bending portion, the output side connection part 62 is allowed to be inclined such that its front end side becomes high. Furthermore, the position of a base end portion of the output side connection part 62 is matched with the position of a front end portion of the boss part 39. In this way, after this positioning is ended, the force to the second bending portion 64*b* is gradually reduced, so that the elastic deformation of the electric wire member E is released and an axial center of the output side connection part 62 becomes horizontal. Accordingly, the output side connection part 62 is fitted around the boss part 39. In this way, after the output side connection part 62 is fitted onto the boss part 39, the entire line part 63 is disposed so as to follow the guide wall 35 and finally the input side connection part 61 is fitted onto the boss part 38, so that the assembling work of the electric wire member E is ended.

As described above, the aforementioned embodiment 2 has the first bending portion 64*a* (corresponding to a unit-side bending portion) positioned at the processing unit 100 side from the base plate 32 and the second to fourth bending portions 64*b* to 64*d* (corresponding to board-side bending portions) positioned at the high voltage board 50 side from the base plate 32.

According to such a configuration, the electric wire members E can be efficiently disposed in a narrow space without interference with peripheral devices of the processing unit 100 and the high voltage board 50.

Furthermore, in the aforementioned embodiment 2, the second bending portion 64*b* of the second to fourth bending portions 64*b* to 64*d*, which are the board-side bending portions, serves as the coil type bending portion having a coil shape of one turn.

Consequently, at the time of the assembling work of the electric wire member E, the electric wire member E is bent or is stretched by employing the coil type bending portion as a support point, so that it is possible to elastically deform the electric wire member E. Consequently, a worker can easily perform the assembling work while elastically deforming the electric wire member E. Furthermore, as compared with the case of dividing the electric wire member E into a plurality of parts, it is possible to reduce the number of parts and assembly man-hours, thereby achieving cost reduction.

In the aforementioned embodiment 2, the second bending portion 64*b*, which is the coil type bending portion, is connected to the end portion of the second linear portion 65*b* facing the high voltage board 50 side.

According to such a configuration, it is possible to allow the coil type bending portion to maximally approach the through hole 36. Thus, it is possible to elastically deform the electric wire member E in the vicinity of the through hole 36 while inserting the electric wire member E into the through hole 36. Thus, it is possible to further easily perform the assembling work of the electric wire member E.

Furthermore, in the aforementioned embodiment 2, the boss part 39 protruding toward the processing unit 100 side is formed on the surface of the base plate 32 facing the processing unit 100 side, and the output side connection part (the end portion of the processing unit 100 side) of the electric wire member E is formed in a coil shape of a plurality of windings and is fitted onto the boss part 39, so that the output side connection part 62 is positioned.

According to such a configuration, at the time of the assembling work of the electric wire member E, it is necessary to perform work for fitting the output side connection part 62 around the boss part 39. Therefore, in a conventional electric wire member E having no coil type bending portion, there is a problem that assemblability deteriorates. On the other hand, in the aforementioned embodiment, as described above, the second bending portion 64*b* is allowed to be the coil type bending portion and the electric wire member E is elastically deformed by employing the second bending portion 64*b* as a support point, so that it is possible to easily fit the output side connection part 62 of the electric wire member E around the boss part 39.

Furthermore, in the aforementioned embodiment 2, the electric wire member E is made of spring steel. According to such a configuration, it is possible to maximally enhance the flexibility (the elasticity) of the electric wire member E. Thus, it is possible to further easily perform the assembling work of the electric wire member E.

In the aforementioned embodiment 2, only the second bending portion 64*b* of the second to fourth bending portions 64*b* to 64*d*, which are the board-side bending portions, is allowed to be the coil type bending portion. However, the present invention is not limited thereto, and for example, all of the second to fourth bending portions 64*b* to 64*d* may also be configured as the coil type bending portion, and the first bending portion 64*a* serving as the unit-side bending portion may also be further configured as the coil type bending portion.

In the aforementioned embodiment 2, the number of windings of the coil type bending portion (the second bending portion 64*b* in the aforementioned embodiment) is one. However, the present invention is not limited thereto, and the number of windings may also be two or more.

What is claimed is:

1. An electric wire member comprising:

a plurality of bending portions that electrically connect a processing unit for performing an image forming process on a paper to a high voltage board for supplying a high voltage to the processing unit;

a linear portion positioned between two of the bending portions; and an expandable portion having a coil shape of a plurality of windings that is expandable and contractable in a coil axis direction, the expandable portion being formed at an intermediate portion of the linear portion, wherein at least one of the bending portions includes a coil type bending portion having a coil shape of one turn or more.

2. The electric wire member of claim 1, wherein a constituent material of the electric wire member is spring steel.

3. An image forming apparatus comprising:

a processing unit that performs an image forming process on a paper;

the electric wire member of claim 1, which supplies electric power to the processing unit; and a holding frame that holds the electric wire member.

4. The image forming apparatus of claim 3, wherein a boss part is formed at a place of the holding frame, which corresponds to the at least one of the bending portions of the electric wire member, and the coil type bending portion of the at least one of the bending portions is fitted onto the boss part, so that the electric wire member is held to the holding frame.

5. An electric wire member comprising:

a plurality of bending portions that electrically connect a processing unit for performing an image forming process on a paper to a high voltage board for supplying a high voltage to the processing unit, wherein at least one of the bending portions includes a coil type bending portion having a coil shape of one turn or more, the electric wire member is disposed so as to pass through a through hole of a partition wall disposed between the processing unit and the high voltage board and electrically connect the processing unit to the high voltage board, the plurality of bending portions include at least one board-side bending portion positioned at a high voltage board side from the partition wall, the at least one board-side bending portion includes the coil type bending portion having the coil shape of one turn or more, a boss part protruding toward a processing unit side is formed on a surface of the partition wall facing the processing unit side, and an end portion of the electric wire member facing the processing unit side is formed in a coil shape of a plurality of windings and is fitted onto the boss part, so that the electric wire member is positioned.

6. The electric wire member of claim 5, further comprising a linear portion that passes through the through hole, and the coil type bending portion is connected to an end portion of the linear portion facing the high voltage board side.

7. The electric wire member of claim 5, wherein a constituent material of the electric wire member is spring steel.

8. An image forming apparatus comprising:

a processing unit that performs an image forming process on a paper;

a high voltage board that supplies a high voltage to the processing unit;

the electric wire member of claim 5, which electrically connects the processing unit to the high voltage board; and an electric wire holding frame having a through hole through which the electric wire member passes and disposed between the processing unit and the high voltage board.

* * * * *